US006568731B2

(12) United States Patent
Alexander, III et al.

(10) Patent No.: US 6,568,731 B2
(45) Date of Patent: May 27, 2003

(54) PIPE LIFTING APPARATUS AND METHOD

(76) Inventors: William J. Alexander, III, P.O. Box 848, Mauldin, SC (US) 29662; Charles Marion Moore, 405 Crestmont Way, Greenville, SC (US) 29615; Chuan Yi Wen, 6 Charlestown Ct., Mauldin, SC (US) 29662

( * ) Notice: Subject to any disclaimer, the term of this patent is extended or adjusted under 35 U.S.C. 154(b) by 0 days.

(21) Appl. No.: 09/814,439

(22) Filed: Mar. 22, 2001

(65) Prior Publication Data

US 2002/0135192 A1 Sep. 26, 2002

(51) Int. Cl.[7] ..... B66C 1/42
(52) U.S. Cl. ..... 294/110.1; 294/117; 294/119
(58) Field of Search ..... 294/110.1, 110.2, 294/117, 118, 119; 414/626, 911

(56) References Cited

U.S. PATENT DOCUMENTS

| | | | | | |
|---|---|---|---|---|---|
| 748,222 | A | * | 12/1903 | Sites | 294/110.1 |
| 1,340,313 | A | * | 5/1920 | Zipp | 294/119 |
| 1,516,031 | A | * | 11/1924 | Venable | 294/110.1 |
| 1,825,179 | A | * | 9/1931 | Collom et al. | 294/118 |
| 2,229,359 | A | * | 1/1941 | York | 294/118 |
| 2,286,071 | A | * | 6/1942 | Dragan et al. | 236/68 B |
| 2,378,570 | A | * | 6/1945 | Mitchell | 294/110.1 |
| 2,384,396 | A | * | 9/1945 | Peyer | 294/110.1 |
| 2,745,695 | A | * | 5/1956 | Peyer | 294/110.1 |
| 3,768,853 | A | * | 10/1973 | Rennie | 294/110.1 |
| 6,012,752 | A | * | 1/2000 | Douglas | 294/110.1 |

FOREIGN PATENT DOCUMENTS

| | | | | |
|---|---|---|---|---|
| RU | 319534 | * | 11/1971 | 294/110.1 |

* cited by examiner

*Primary Examiner*—Dean J. Kramer
(74) *Attorney, Agent, or Firm*—Ralph Bailey

(57) ABSTRACT

A pipe lifting apparatus and method utilizes gripper arms (A) having upwardly diverging links (B) pivotally connected to an upwardly extending operator member (C) for receiving a lifting attachment and for moving a stirrup (D) from side to side to lock and unlock stops (E) for fixing the gripper arms and in unlocked position for a next pipe lifting operation. Auxiliary gripping members (F) are provided in opposed relation on each of the gripper arms for adjusting the effective gripping action afforded by the gripping arms to accommodate multiple size pipes.

27 Claims, 6 Drawing Sheets

PIPE LIFTING APPARATUS AND METHOD

BACKGROUND OF THE INVENTION

This invention relates to apparatus and method for gripping and lifting sections of concrete pipe wherein gripper arms are first locked in position for transport and then unlocked for a next pipe lifting operation without manual manipulation of the gripping apparatus.

The prior art includes lifting tongs having pivoted depending gripper arms and upwardly diverging links extending therefrom that are connected through converging pivotal links to an upper pivotal connection. U.S. Pat. Nos. 1,825,179, 1,966,240, 3,945,676, 4,023,848, and 5,842,729 are exemplary of the prior art. The prior art includes the use of an auxiliary line for operating a latch securing the gripper arms in open position.

The prior art further includes a concrete pipe lifter by KENCO of Ligonier Valley, Pa. that utilizes opposed gripper arms joined by a pivot disposed longitudinally of the concrete pipes and having diverging upwardly extending links. The diverging links are connected by pivoted converging links to a pivot point at a lower end of an upright connector or operator plate. The connector plate has a fastener at its upper end for securement to suitable power operated lifting or hoisting apparatus that includes a linear connector such as a hook and cable. Latches are provided for securing the linkage in fixed open position for transport. However, the latches must be released manually for permitting the gripper arms to grip and carry a pipe. The latches have pivotal connection at the pivot point at the lower end of the connector plate, maintaining the gripper arms in spread relation for lifting a concrete pipe or other elongated object for transport preparatory to a next pipe lifting operation. The latches may then be manually freed to release the gripper arms for the next lifting operation.

The KENCO pipe lifter is capable of lifting concrete pipes within a limited range of sizes. However, because there is only a single latched position permitted by the manually operable latches the gripper arms must be opened by a fixed amount to accommodate the largest pipe size. The large fixed opening of the gripper arms requires that the ditch for receiving the pipe be of sufficient width to accommodate the largest pipe size even though a relative small pipe is to be placed in the ditch. Because of the large fixed opening, the gripper arms are capable of exerting only a limited gripping action on pipes of small sizes thus resulting in slippage of the concrete pipes. Moreover, manually operable fastening means are very difficult to manipulate in normal use in pipe laying.

SUMMARY OF THE INVENTION

Accordingly, it is an important object of this invention to provide pipe lifting apparatus and method suitable for use on a range of concrete pipe sizes permitting several opening spacings between the gripper arms to assure an effective gripping action on a relatively broad range of pipe sizes and avoid excessive spacing as would necessitate a ditch of inordinate size to accommodate a relative small pipe.

Another important object of the invention is the provision of apparatus including opposed pivoted gripper arms having a pivoted operator member extending upwardly for attachment to a lifting cable and the like wherein stops are provided for selective locking and unlocking responsive to manipulation of the operator member transversely of the pipes for fixing the gripper arms automatically for transport to a location for a next pipe laying sequence. The operator member is manipulated by movement as by a lift cable from side to side as needed for engagement and release of the respective stops.

Still another important object of the invention is the provision of opposed adjustable auxiliary wedge-shaped gripping members carried by opposed gripping arms above the center of gravity of the pipes to accommodate various sizes of pipes through an adjustable fixed gripping action.

The stop mechanism or device is operated by movement of the lift cable preferably through an upright operator member in the form of a plate longitudinally pivoted at its lower end. The stop mechanism includes transversely spaced members carried by upright links forming a stirrup having an upright locking arm pivotally connected on a lower end at a pivotal juncture of the gripper arms and having spaced pin engaging stops for receiving a transverse pivot pin extending outwardly from an upper pivotal connection aligned above the juncture of the gripper arms. The pin engaging stops are preferably carried by a locking plate adjustably positionable on the upright arm to permit locking engagement for only one pipe size per position.

A pin is provided for selective engagement within spaced holes in the links for limiting closure of the links by more than an amount desirable for engaging respective stops.

While the invention has been described in the context of laying concrete pipes it is believed that many uses for the invention will be found, for example, manipulating other elongated articles such as poles, logs, steel pipes and the like. The term lift cable has been used herein for descriptive purposes but it is to be understood that this term encompasses any suitable elongated linear expedient such as slings, straps, rope and the like capable of performing the lift function.

Because manual operation of latches has been avoided efficiency in pipe laying has been increased. Moreover, a greater range of pipe sizes may be accommodated by a single adjustable pipe lifter.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Apparatus and method for gripping and lifting pipe sections for transport utilizing a gripper having tongs connected by a pivot intermediate their ends define opposed depending gripper arms A and upwardly diverging links B. The links B are pivotally connected adjacent to a lower end of an upwardly extending operator member C for connection to a lifting cable and the like carried by a power operated hoist controlled by hoist operator. A stop mechanism includes a stirrup D having upright locking arms E for locking the diverging links against an upward force thus maintaining the gripper arms fully open for transport of the pipe lifting apparatus to a location preparatory to gripping and lifting a pipe section by moving a lifting cable laterally with the operator member C connected thereto for manipulation of the stirrup. The gripper arms A are transported in open position for alignment preparatory to encompassing the pipe section. The stop mechanism is then disengaged by operator manipulation of the operator member C freeing the gripper arms for gripping and lifting another pipe section.

The method of gripping and lifting pipe sections further includes mounting auxiliary gripping members F in opposed fixed relation on each of the opposed gripper arms in a position above the center of a pipe section to be lifted with a lower engaging end of respective gripper arms extending below the center of the pipe section. A pipe engaging surface on the auxiliary gripping members may extend inwardly of an inner surface of the gripper arms creating a four-point gripping engagement of the pipe section illustrated at 12 in FIGS. 7–14.

Figure 1:
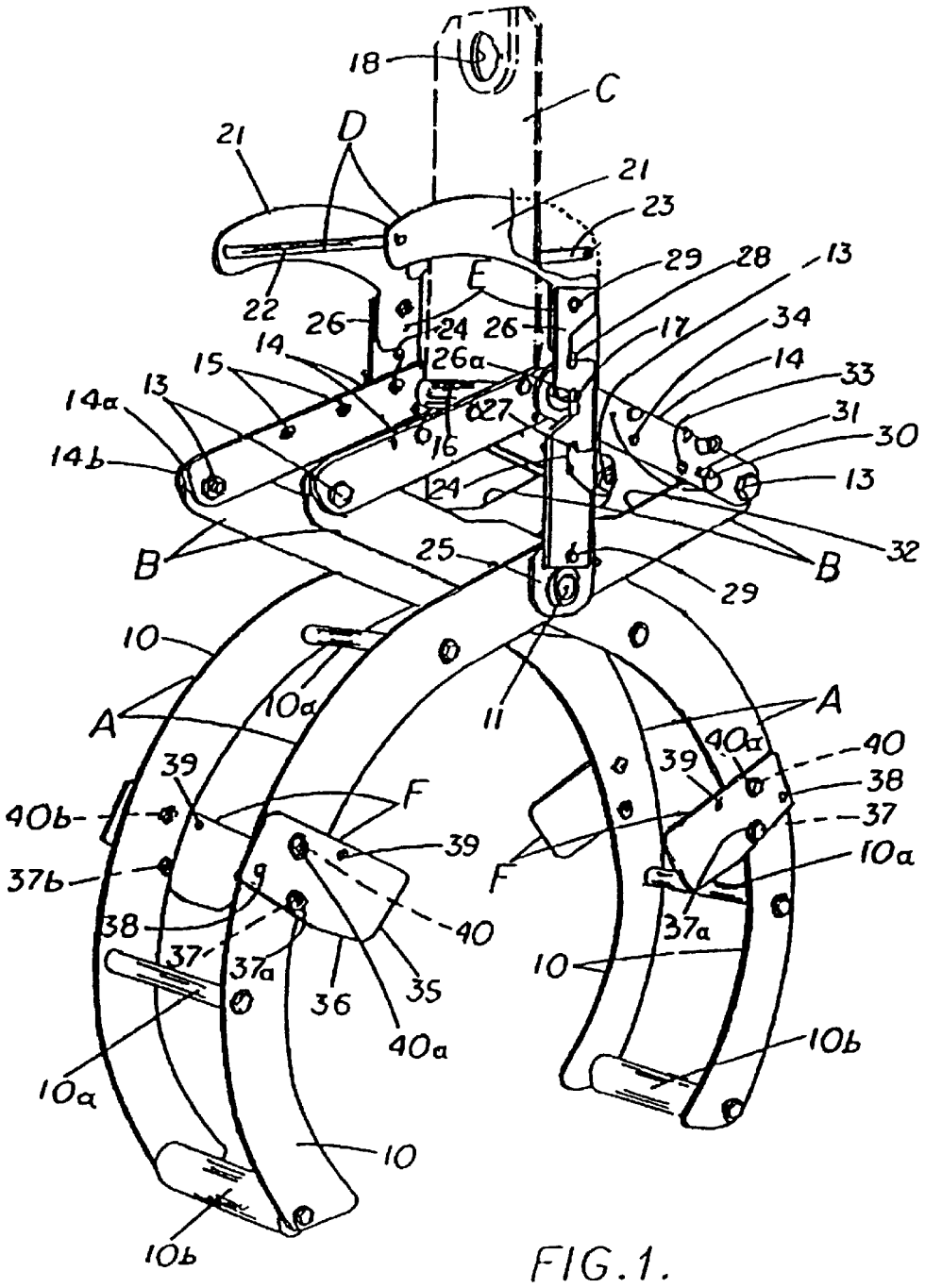
FIG. 1 is a left front perspective view illustrating a pipe lifting apparatus, constructed in accordance with the invention, with gripper arms secured in open position for gripping the smallest of a range of concrete pipe sizes, utilizing auxiliary gripping apparatus adapted to additionally engage the pipe above its center line.

FIG. 1 further illustrates the gripper arms A as including longitudinally spaced arcuate members 10 bridged by spacer bars 10*a*. The gripper arms are pivotally joined as by the longitudinal pin 11. The lower ends of the gripper arms A are provided with enlarged spacer members 10*b*. The arcuate members extend upwardly past the pivot point 11 as diverging linkage members B, each of which have pivotal connections as at 13 to upwardly converging links 14. The links 14 are preferably composite members 14a and 14*b* which are bolted together as at 15 with adjacent ends of the diverging members sandwiched therebetween.

An upwardly extending operator member C is provided in the form of a plate and is pivotally carried at a lower end as at 16 upon a longitudinal pivot pin 17. The pin 17 pivotally connects the upper free ends of the composite linkage 14 and projects outwardly beyond the linkage at each end. The operator member C has a suitable connector 18 that is illustrated as including an opening at its upper end for accommodating a hook 19, FIG. 14 for securement of a lifting cable 20. The lifting cable 20 may be provided in the form of a rope, strap or other suitable linear connecting member such as a metallic cable for connecting the pipe lifting apparatus to a power operated lifting mechanism (not shown).

A stop device includes a stirrup D carried by the upright locking arms E. The stirrup is illustrated as including arcuate generally horizontal upper members 21 joined by a longitudinal operator member 22 bridging their free ends with a complimentary member 23 are carried on opposite ends of the horizontal members 21. The upwardly extending operator C is carried between the operator members 22 and 23. for actuation of the locking mechanism as described below.

Figure 2:
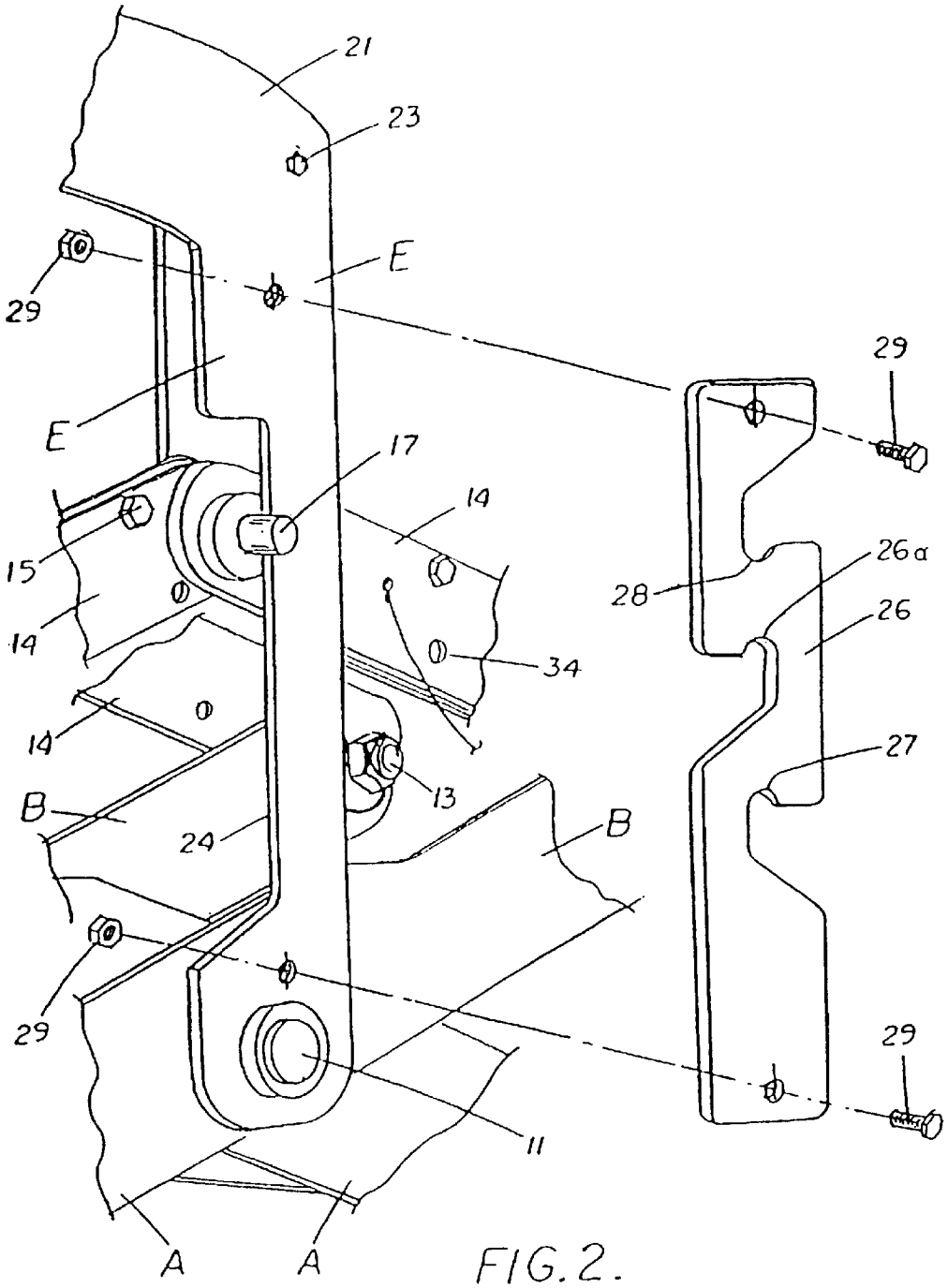
FIG. 2 is an enlarged perspective view further illustrating a stop apparatus including a stirrup having an upright arm pivoted at a pivot point between the tong members forming the gripper arms together with a locking plate carried by the upright arm for selectively positioning stops for locking and unlocking the gripper arms.
Figure 3:
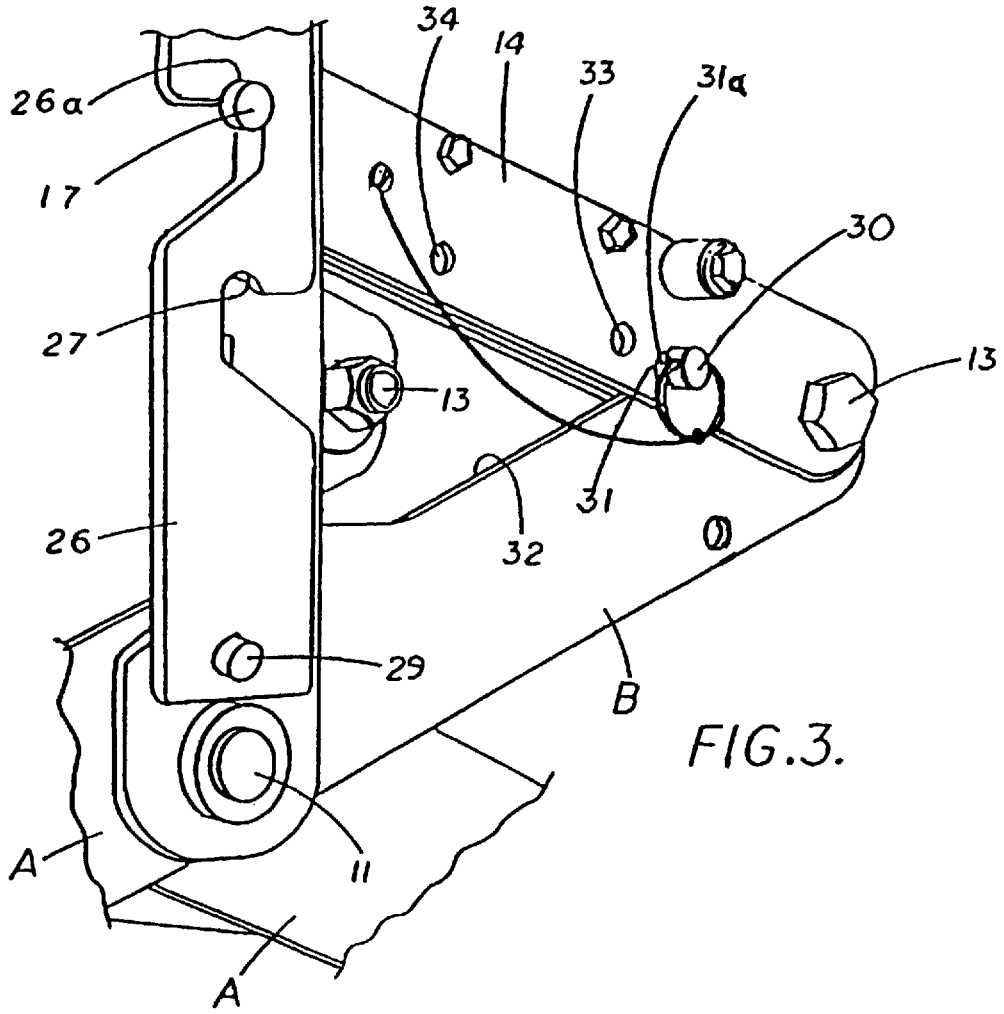
FIG. 3 is an enlarged perspective view illustrating a pin carried by the links that is selectively positionable to aid in locking and unlocking the gripper arms by limiting collapse of the linkage to an amount commensurate with achieving locking and unlocking of the gripper arms at a desired opening.
Figure 4:
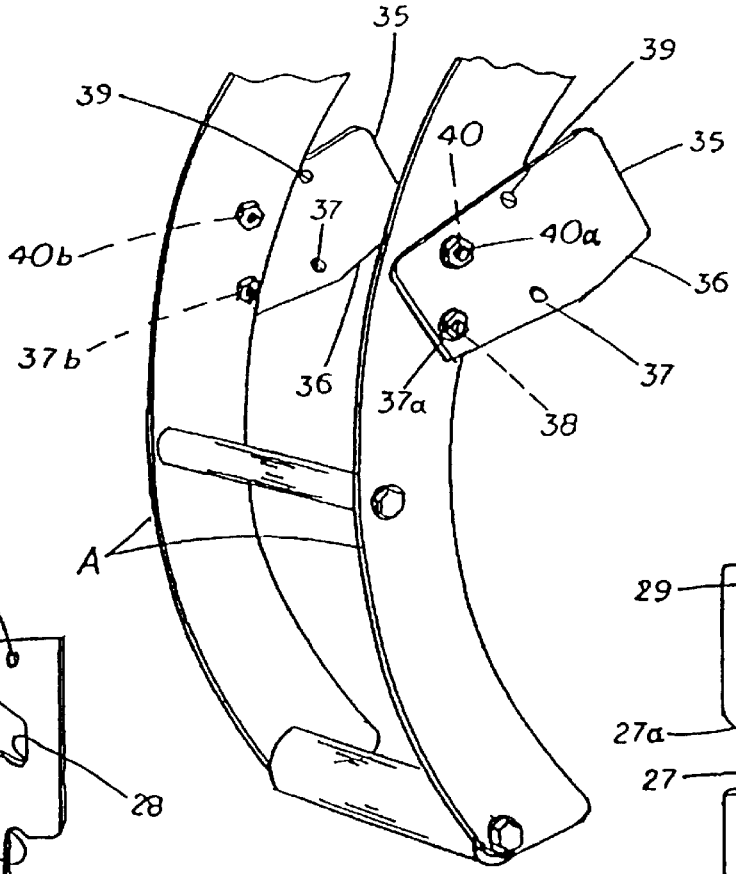
FIG. 4 is a front elevation, at an enlarged scale, illustrating the auxiliary lifting apparatus with parts rotated into position for engaging an intermediate size pipe.
Figure 5:
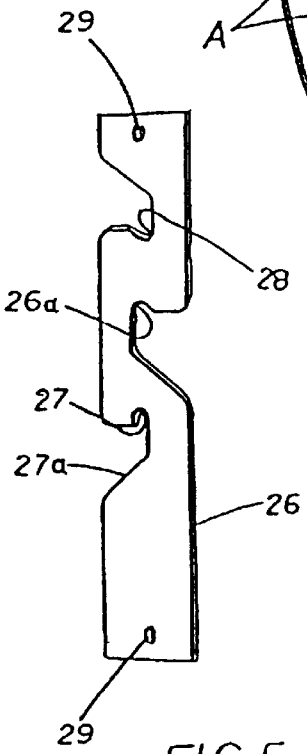
FIG. 5 is a front view illustrating a locking plate of the stop device having been removed from a locking arm and in position for fixing the lifting apparatus in open position to accommodate an intermediate size pipe.
Figure 6:
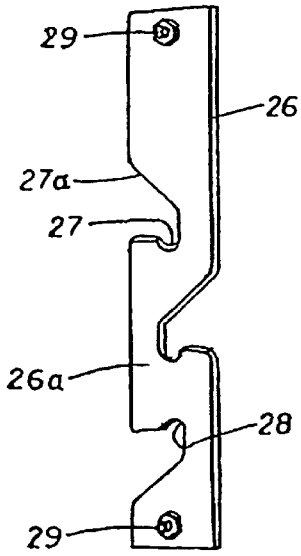
FIG. 6 is a front view illustrating the locking plate in position to receive the largest pipe in the range illustrated, for example, a 36-inch pipe.
Figure 7:
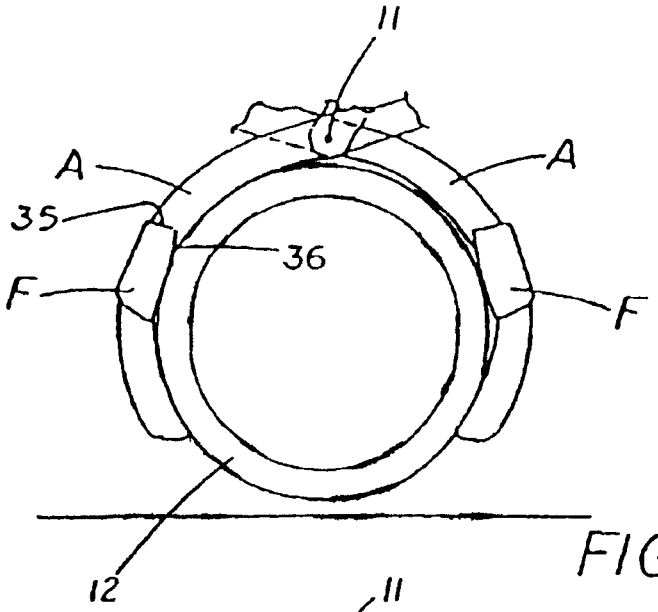
FIG. 7 is a schematic front elevation illustrating the auxiliary lifting apparatus in position on opposed gripper arms to accommodate a largest pipe size.
Figure 8:
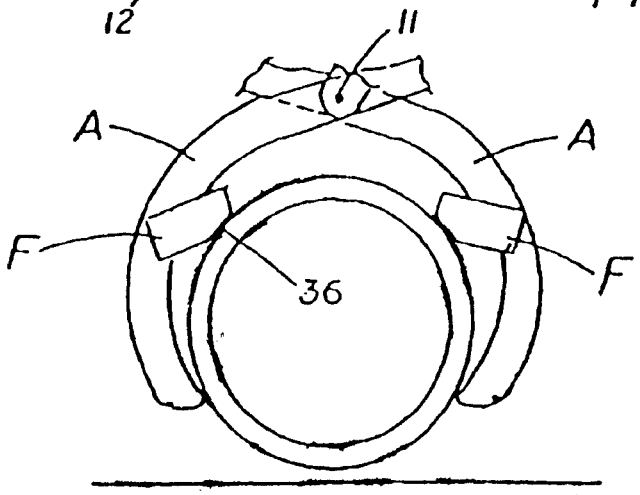
FIG. 8 is a schematic front elevation illustrating the auxiliary lifting apparatus in position for accommodating an intermediate pipe size.

The stop device further includes upright locking arms E extending integrally downwardly from an end of the horizontal members 21 adjacent to the member 23. Each locking arm is provided with a notched intermediate section 24. The integral downwardly extending locking arms E are each pivoted at respective lower ends 25 on the longitudinal pivot pin 11. The notched sections 24 in FIG. 1 form carrier portions for respective locking plates 26. A stop surface 26*a* is shown in engagement with the pin 17 for receiving the smallest of the pipes 12. The locking plates 26 are shown in greater detail in FIGS. 2, 5 and 6. In FIG. 5 the locking plates are positioned so that a stop surface 27 within a guide slot 27*a* is accessible for receiving the outwardly projecting pins 17 for producing an intermediate gripper spacing. The stop surface 28 accommodates the largest range of pipe sizes. The stop surface 27 accommodates pipes of intermediate size. The locking plates may be fixed in their respective positions by the bolts 29.

Thus, the locking plates 26 prevent the tongs from opening more than is necessary to lock onto or release a given size pipe. This allows the ditch or trench width in many instances to be less than it would have to be using conventional pipe lifts.

The lower positions of the upwardly converging links 14 are determined by the positioning of a pin 30 which selectively extends into one of three holes. The hole 31 which is illustrated as receiving the pin in FIG. 1 accommodates the smallest size of pipe and a shank 31*a*. The pin 30 bears against an upper side 32 of the diverging links B. In that position of the pin the lower position of the arm is permitted with the largest spread or height of the pivot pin 17. Holes 33 and 34 position the arms for receiving pipes of intermediate size and largest size, respectively. The pin 30 is relocated as determined by the size of pipe being laid.

Figure 9:
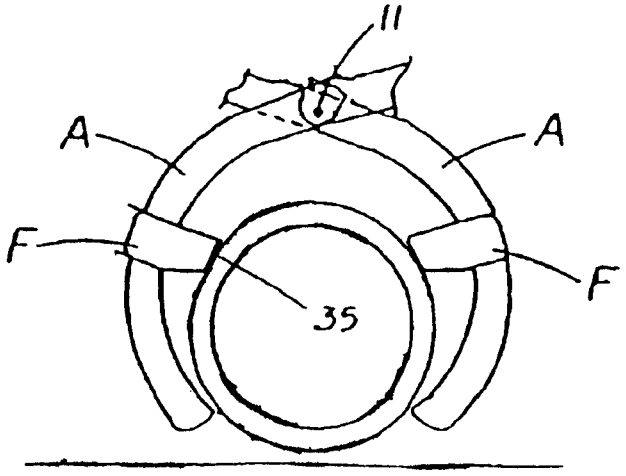
FIG. 9 is a schematic front elevation illustrating position of a pipe of smallest size.
Figure 10:
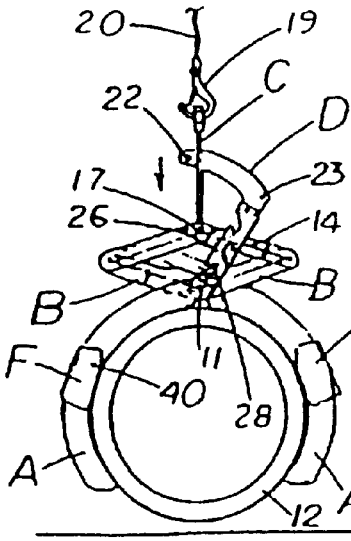
FIG. 10 is a schematic front elevation, at a reduced scale, illustrating the first of a sequence of operations for lifting the largest of a range of pipe sizes wherein the gripper arms are engaged for carrying a pipe that is being lowered preparatory to depositing the pipe on the ground as illustrated or in a ditch.
Figure 11:
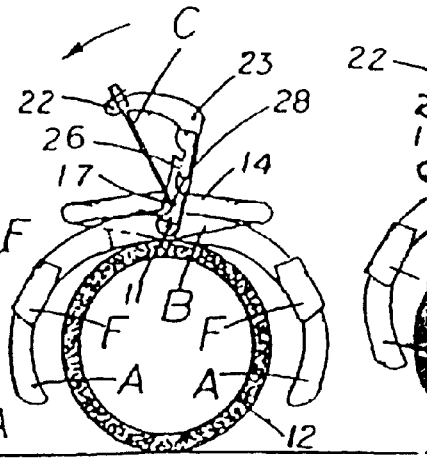
FIG. 11 illustrates the stop device being pivotal counterclockwise preparatory to engaging linkage in lower most position for maintaining the gripper arms open releasing the pipe and for transport.
Figure 12:
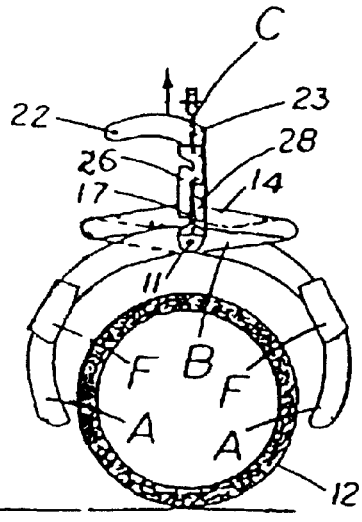
FIG. 12 illustrates the stop device engaging the linkage in lower most position for transporting the gripper arms in entirely open position preparatory for transport to engage another pipe.
Figure 13:
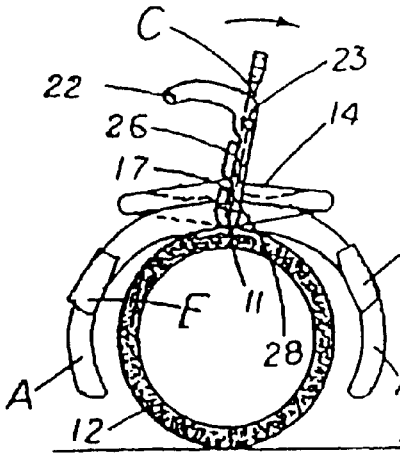
FIG. 13 illustrates lowering of the gripper arms for disengaging the stop mechanism preparatory to engagement of the gripper arms for lifting the pipe.
Figure 14:
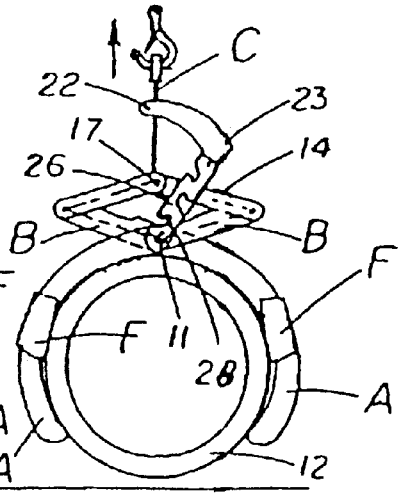
FIG. 14 illustrates the step of lifting the pipe with the gripper arms engaged.

Auxiliary gripping members F are best illustrated in FIGS. 1, 4, and 7–9 as being wedge-shaped shoes positioned so as to provide a surface 35 for engaging pipes of smallest size as in FIGS. 1 and 9. A surface 36 is provided for engaging pipes of intermediate size as in FIGS. 4 and 8 whereas the wedge-shaped members are pivoted to a position out of the way and in substantial alignment with the arcuate gripper arms A to accommodate pipes of the largest size as shown in FIGS. 7, and 10–14. The smallest of the pipes is accommodated by securing a bolt 37*a* in opening 37 opposite the bolt 40*a* in opening 40 as shown in FIG. 1. Openings 37*b* and 40*b* in arcuate members 10 also receive the bolts 37 and 40. The remaining pipe sizes are accommodated by rotation of the wedge-shaped members F about the bolt 40*a* in wedge opening 40 with the bolt 37*a* passing through opening 38 or 39 as indicated. The opening 39 receives the bolt 37*a* to position the largest size pipe. The bolt 40 is preferably never removed but may be loosened with removal of the bolt 37*a* to permit rotation of the wedges F to make adjustments necessary for positioning the gripping members F.

While a preferred embodiment of the invention has been described using specific terms relating to lifting concrete pipe sections, such description is for illustrative purposes only, and it is to be understood that changes and variations, including the use of any suitable linear lifting device, for lifting other elongated objects may be made without departing from the spirit or scope of the following claims.

What is claimed is:

1. A method of gripping and lifting pipe sections for transport utilizing tongs pivotally connected intermediate their ends defining opposed depending gripper arms and upwardly diverging links connected to a linear lifting member comprising the steps of:

lowering the tongs, opening the opposed depending gripper arms, releasing a pipe section and thereby lowering the upwardly diverging links;

then moving the linear lifting member laterally engaging a stop fixing the gripper arms for transport in open position; and transporting to and then positioning the open gripper arms over and encompassing a pipe section.

2. A method of griping and lifting a pipe section for transport utilizing tongs connected by a pivot intermediate their ends defining opposed depending gripper arms and upwardly diverging links connected to a linear lifting member comprising the steps of;

lowering the opposed depending gripper arms releasing a pipe section and thereby lowering the upwardly diverging links;

moving the linear lifting member laterally engaging a stop for securing the diverging links in a lowered position thus maintaining the gripper arms in an open position for transport to a location preparatory to receiving, gripping and lifting a pipe section;

transporting the open gripper arms and positioning them over and encompassing a pipe section; and then moving the lifting member laterally disengaging the stop freeing the gripper arms for gripping and lifting the pipe section.

3. The method set forth in claim 2 wherein the step of disengaging the stop includes lowering the tongs upon the pipe section thus spreading the gripper arms and lowering the upwardly diverging links.

4. The method set forth in claim 3 including the step of limiting the extent to which the links may be lowered.

5. A method of griping and lifting a pipe section for transport utilizing tongs connected by a pivot intermediate their ends defining opposed depending gripper arms and upwardly diverging links pivotally connected to a linear lifting member comprising the steps of:

engaging a stop for securing the diverging links in a lowered position thus maintaining the gripper arms in an open position for transport to a location preparatory to receiving, gripping and lifting a pipe section;

transporting and positioning the tongs over and with the opposed gripper arms encompassing the pipe section; and moving the linear lifting member laterally in a direction for disengaging the stop freeing the gripper arms responsive to lateral movement of the linear lifting member for gripping and lifting the pipe section.

6. The method set forth in claim 5 further comprising the steps of:

mounting auxiliary gripping members in opposed relation on each of the opposed gripper arms in a position above the center of a pipe section to be lifted with a lower end of respective gripper arms extending below the center of the pipe section; and providing a pipe engaging surface on said auxiliary gripping members extending inwardly of an inner surface of the gripper arms creating a gripping engagement of the pipe section.

7. The method set forth in claim 6 including the step of adjusting and fixing the position of the auxiliary gripping members on the opposed gripper arms thereby adjusting the spacing of the pipe engaging surfaces.

8. A method of griping and lifting a pipe section utilizing tongs connected by a pivot intermediate their ends defining opposed gripper arms and upwardly diverging links comprising the steps of:

selecting and engaging one of a plurality of spaced stops positioning the gripper arms in selected spaced positions;

mounting auxiliary griping members in opposed relation on each of the opposed gripper arms in a position above the center of a pipe section to be lifted with lower end of respective gripper arms extending below the center of the pipe section; and providing opposed pipe engaging surfaces on said auxiliary gripping members extending inwardly of an inner surface of the gripper arms creating together with opposed lower surfaces of the gripper arms a gripping engagement of the pipe section.

9. The method set forth in claim 8 including the step of adjustably fixing the auxiliary gripping members in multiple fixed positions for varying the size of the pipe sections that may be lifted.

10. The method set forth in claim 8 including the step of providing a plurality of stops for locking and unlocking the gripper arms for achieving a spacing therebetween commensurate with minimal amount necessary to engage a pipe section of a given size.

11. A pipe lifting apparatus having gripper arms including upwardly diverging links [pivotally connected] having a pivotal connection to an upwardly extending operator member for receiving a lifting attachment comprising:

a pair of upright locking arms pivotally carried adjacent to said pivotal connection;

spaced stops intermediate the ends of the upright locking arms; and a stirrup moveable laterally to engage the spaced stops intermediate the ends of the upright locking arms for locking the gripper arms in predetermined open positions for transport and then unlocking the gripper arms preparatory to a pipe lifting operation.

12. The pipe lifting apparatus set forth in claim 11 including auxiliary gripping members in opposed relation on each of the gripper arms to accommodate the pipes of multiple sizes.

13. The pipe lifting apparatus set forth in claim 12 wherein the gripping members are wedged-shaped having multiple gripping surfaces fixedly carried by the gripper arms.

14. The pipe lifting apparatus set forth in claim 12 including converging links pivotally connected to the diverging links having spaced openings for selectively carrying a pin engaging an opposite diverging link for siding in locking the gripper arms.

15. A pipe lifting apparatus for attachment to a power-operated linear lifting member comprising:

a pair of opposed gripper arms having diverging links extending upwardly from a pivot point;

upwardly converging links pivotally carried by the upwardly diverging links and having a pivotal connection at upper ends; and a stirrup movable laterally in response to lateral movement of the linear lifting member to engage stops for fixing the gripper arms in open position for transport and to disengage stops permitting a pipe lifting operation.

16. The pipe lifting apparatus set forth in claim 15 including an upwardly extending operator member pivotally connected to the upwardly converging links.

17. The pipe lifting apparatus set forth in claim 15 wherein the stirrup includes an upright locking arm having space longitudinal operator members at an upper end, and a lower end pivotally mounted at the pivot point in response to lateral movement of the linear lifting member between the spaced longitudinal operator members.

18. The pipe lifting apparatus set forth in claim 17 wherein the locking arm has a reduced notched intermediate section, and a locking plate carrying at least one stop on each side overlapping the intermediate section so that one stop at a time is available for receiving the pivotal connection between the upwardly diverging links.

19. A pipe lifting apparatus comprising:

a pair of opposed gripper arms;

upwardly diverging links at an upper pivoted end of the opposed gripper arms;

pivoted converging links pivotally connected at upper ends carried by the upwardly diverging links;

an upwardly extending operator member for receiving a lifting attachment;

a stirrup moveable laterally in response to movement of the operator member for locking the gripper arms in open position; and stops carried by locking arms movable by the stirrup for freeing the gripper arms for a pipe lifting operation.

20. The pipe lifting apparatus set forth in claim 19 including:

auxiliary wedge-shaped gripping members in opposed relation on each of the gripper arms for adjusting gripping surfaces to accommodate pipes of multiple sizes.

21. A pipe lifting apparatus having gripper arms with upwardly diverging links pivotally connected to an upwardly extending operator member for receiving a lifting attachment comprising:

a pair of upright locking arms having spaced intermediate stops;

a stirrup moveable laterally to engage the stops on the upright locking arms for fixing the gripper arms in open position for transport preparatory to a pipe lifting operation; and auxiliary wedge-shaped gripping members in opposed relation on each of the gripper arms for adjusting spacing between opposed gripper surfaces to accommodate pipes of multiple sizes.

22. The pipe lifting apparatus set forth in claim 21 including multiple openings in the wedge-shaped gripping members corresponding to the opening in the gripper arms permitting rotation of the wedge-shaped gripping members about a single pair of corresponding openings for achieving multiple position of the wedge-shaped members.

23. The pipe lifting apparatus set forth in claim 21 including spaced stops carried by adjustable locking plates on the locking arms for limiting the spacing of gripper arms to an amount permitting gripping a pipe of a given size.

24. A pipe lifting apparatus comprising:

a pair of opposed gripper arms having upwardly diverging links;

upwardly converging links pivotally connected at upper ends to the opposed gripper arms;

a plurality of spaced stops on an intermediate portion of the converging links; and a stirrup moveable laterally to engage the stops for fixing the gripper arms permitting limited open positions therebetween for transport preparatory to a pipe lifting operation.

25. The pipe lifting apparatus set forth in claim 24 wherein the stirrup includes an upright locking arm, and a locking plate having spaced stops therein adjustable to permit engagement of stops desired to provide the limited open positions.

26. A pipe lifting apparatus comprising:

a pair of opposed gripper arms;

upwardly diverging links;

pivoted connected links pivotally connected at upper ends;

operator member for receiving a lifting attachment;

a stirrup laterally moveable to engage stops on upright locking arms;

stops on adjustable plates carried by locking arms for fixing the gripper arms in open positions dictated by pipe sizes for transport prepartory to a pipe lifting operation; and an adjustable positionable pin lifting operation; and diverging links limiting the extent to which the links may collapse to facilitate engagement of the stops.

27. The pipe lifting apparatus set forth in claim 26 including auxiliary wedge-shaped gripping members in opposed relation on each of the gripper arms for fixedly adjusting gripping surfaces to accommodate pipes of multiple sizes.

* * * * *